US007290694B2

(12) United States Patent
Kirby et al.

(10) Patent No.: US 7,290,694 B2
(45) Date of Patent: Nov. 6, 2007

(54) STAPLER WITH DETACHABLE ACCESSORY

(75) Inventors: David W. Kirby, Lemont, IL (US); Bikramjeet S. Sohi, Buffalo Grove, IL (US); Stephen J. Gaynes, McHenry, IL (US); Richard J. Page, Lake Villa, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 52 days.

(21) Appl. No.: 11/097,090

(22) Filed: Apr. 1, 2005

(65) Prior Publication Data

US 2005/0223498 A1 Oct. 13, 2005

Related U.S. Application Data

(60) Provisional application No. 60/559,319, filed on Apr. 2, 2004.

(51) Int. Cl.
*B25F 1/00* (2006.01)

(52) U.S. Cl. ..... 227/156; 227/63; 227/120; 7/160

(58) Field of Classification Search ..... 227/63, 227/156, 8, 120, 121, 135, 136, 137; 7/160
See application file for complete search history.

(56) References Cited

U.S. PATENT DOCUMENTS

| | | | | |
|---|---|---|---|---|
| 2,832,959 | A | 5/1958 | Pankonin | |
| 2,939,146 | A * | 6/1960 | Abrams | 227/120 |
| 3,056,584 | A | 10/1962 | Pankonin | |
| 3,563,513 | A | 2/1971 | Rubin et al. | |
| 3,672,635 | A | 6/1972 | Munson et al. | |
| 4,002,281 | A | 1/1977 | Hsu | |
| 4,114,793 | A | 9/1978 | Hsu | |
| 4,491,261 | A * | 1/1985 | Mitsuhashi | 227/76 |
| 4,727,610 | A | 3/1988 | Lin | |
| 4,838,470 | A | 6/1989 | Chang | |
| 5,183,196 | A | 2/1993 | Miyashita | |
| 5,184,765 | A | 2/1993 | Orozco | |
| 5,513,833 | A | 5/1996 | Kirk | |
| 5,562,681 | A | 10/1996 | Crainich | |

(Continued)

FOREIGN PATENT DOCUMENTS

| | | |
|---|---|---|
| WO | 03074235 | 9/2003 |

OTHER PUBLICATIONS

International Search Report and Written Opinion issued on Sep. 7, 2006, for corresponding International Application No. PCT/US2005/011176.

*Primary Examiner*—Thanh K. Truong
*Assistant Examiner*—Michelle Lopez
(74) *Attorney, Agent, or Firm*—Michael Best & Friedrich LLP

(57) ABSTRACT

A stapler and detachable accessory combination includes a stapler having a base with an accessory storage chamber. A detachable accessory defines an operating end, a non-operating end, and a grasping portion intermediate the operating and non-operating ends. The detachable accessory is insertable into and removable from the storage chamber such that the operating end leads during insertion into the storage chamber and the non-operating end leads during removal from the storage chamber. The accessory can be a staple remover, a hole punch, a pencil sharpener, or other office tool.

17 Claims, 6 Drawing Sheets

U.S. PATENT DOCUMENTS

| | | | | |
|---|---|---|---|---|
| D383,783 | S | 9/1997 | Jeter et al. | |
| 5,979,734 | A | 11/1999 | Chang | |
| 6,062,456 | A | 5/2000 | Patti et al. | |
| 6,089,435 | A | 7/2000 | Malek | |
| 6,244,489 | B1 | 6/2001 | Laurie | |
| 6,371,349 | B2 | 4/2002 | Laurie | |
| 7,143,922 | B2 * | 12/2006 | Shevin-Sandy | 227/156 |
| 2002/0064040 | A1 | 5/2002 | Padden | |
| 2005/0217032 | A1 | 10/2005 | Bruggisser | |

* cited by examiner

STAPLER WITH DETACHABLE ACCESSORY

RELATED APPLICATIONS

This application claims priority to U.S. Provisional Patent Application No. 60/559,319 filed Apr. 2, 2004, which is hereby incorporated by reference.

FIELD OF THE INVENTION

The invention relates to staplers.

BACKGROUND OF THE INVENTION

It has been known to attach accessory devices (e.g., staple removers) to staplers in numerous manners.

SUMMARY OF THE INVENTION

Prior art methods of attaching accessories to staplers have typically resulted in stapler assemblies that are awkward to use and that are unpleasing to the eye. Additionally, attaching and removing the accessory from the stapler typically requires more than minimal manipulation of the accessory, and can often be quite cumbersome.

The present invention provides an improved combination comprising a stapler and a detachable accessory. The stapler has a base with an accessory storage chamber. The detachable accessory has an operating end, a non-operating end, and a grasping portion intermediate the operating and non-operating ends. The accessory is insertable into and removable from the storage chamber such that the operating end leads during insertion into the storage chamber and the non-operating end leads during removal from the storage chamber. The user grasps the grasping portion with fingers in an operating position to operate the accessory when detached from the stapler. The user inserts the accessory into the storage chamber and removes the accessory from the storage chamber without substantially moving his fingers from the operating position.

In one embodiment, the accessory comprises a jaw-type staple remover, where the operating end is an end of the remover defining staple grasping claws, and where the non-operating end is a pivot end. In another embodiment, the accessory comprises a hole punch, where the operating end is an end of the punch having a punch pin, and where the non-operating end is a pivot end. In yet another embodiment, the accessory comprises a pencil sharpener, where the operating end is an end of the sharpener defining a pencil-insertion opening. Other accessories can also be used.

Other features and advantages of the invention will become apparent to those skilled in the art upon review of the following detailed description and drawings.

Figure 1:
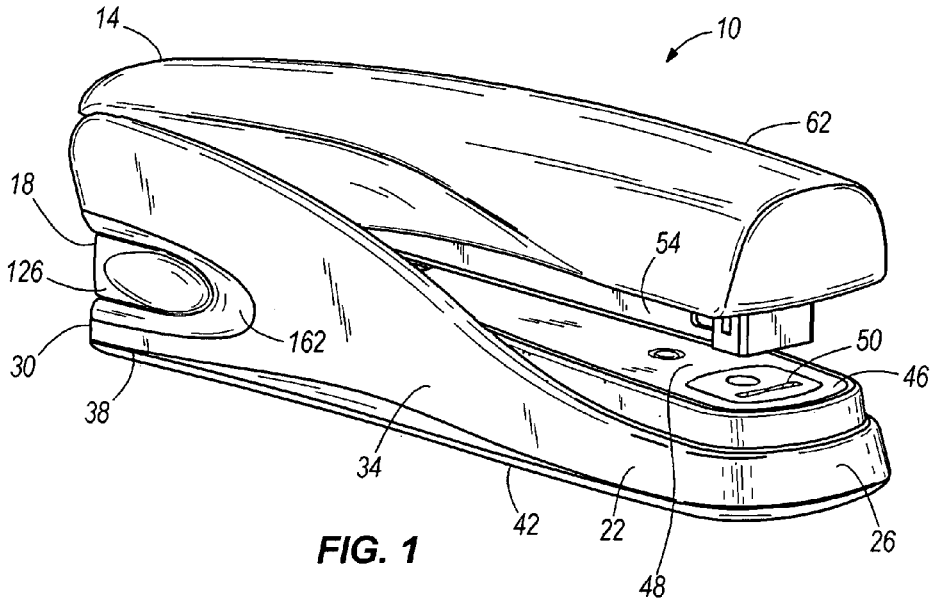
FIG. 1 is a front perspective view illustrating a stapler and accessory combination embodying the invention.
Figure 2:
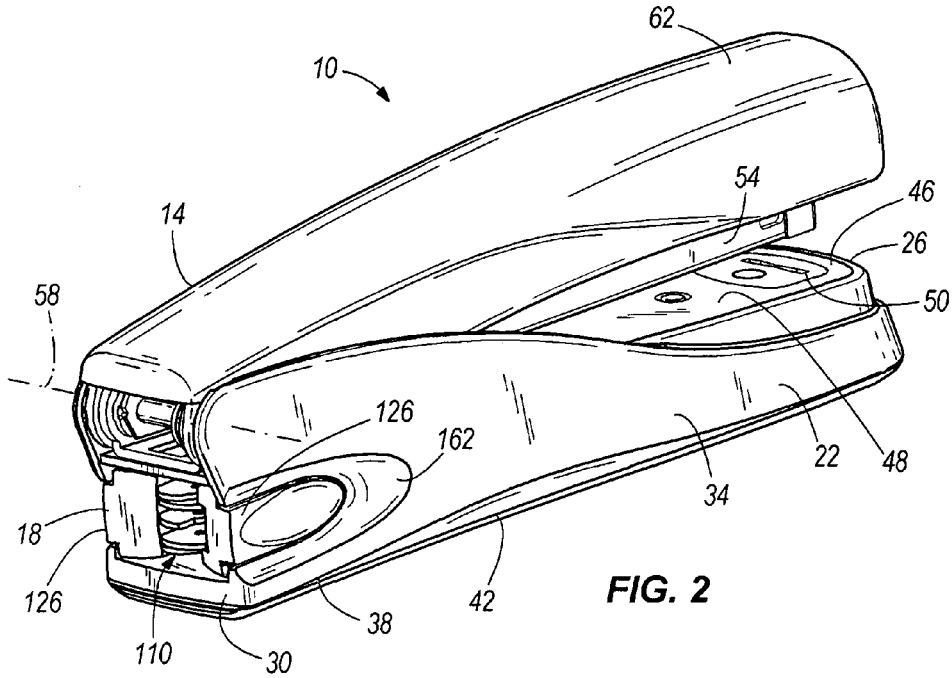
FIG. 2 is a rear perspective view of the stapler and accessory combination of FIG. 1.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items.

DETAILED DESCRIPTION OF THE PREFERRED EMBODIMENT

FIGS. 1-6 illustrate a stapler and detachable accessory combination generally designated by the reference numeral 10. The combination 10 includes a stapler 14 and a detachable accessory 18. The illustrated stapler 14 is a manual desktop-type stapler. However, the invention can be practiced with substantially any type of stapler, including, but not limited to, manual hand-held or upright staplers, manual heavy-duty staplers, and all forms of electric staplers, including desktop-type, heavy-duty, and hand-held electric staplers.

The illustrated stapler 14 includes a base 22 having a front end 26, a rear end 30, and opposite sides 34. A bottom 38 of the base is covered by a slipper or pad 42 that helps stabilize and minimize sliding movement of the stapler 14 on a support surface (not shown).

The stapler 14 also includes a spine 46 coupled with the base 22. In the illustrated stapler 14, the spine 46 is a steel component that provides strength and stability to the stapler 14. An upper surface 48 of the spine 46 is configured to receive and support a stack of sheets (not shown) to be stapled. An anvil 50 is supported by the spine 46 for clinching staples driven through the stack of sheets.

A staple magazine 54 is pivotally connected to the rear end 30 of the base 22 and the spine 46 about a pivot axis 58, as is understood in the art. A cover 62 is also pivotally connected to the spine 46 about the pivot axis 58, and is capable of pivoting both with the magazine 54 and with respect to the magazine 54 during stapling operations. The cover 62 also pivots away from the magazine 54 to facilitate re-filling the magazine 54 with staples. A case 64 (see FIG. 4) is also pivotally connected to the spine 46 about the pivot axis 58. The case 64 at least partially closes the upper portion of the magazine 54 when the cover 62 is in the closed position, and pivots with the cover 62 to the open position for re-filling the magazine 54 with staples.

The pivot axis 58 is defined in part by a yoke portion 66 of the spine 46. The yoke portion 66 includes a base portion 70 and opposite upstanding mounts 74. The base portion 70 is supported by a generally horizontal wall 78 at the rear end 30 of the stapler base 22. The upstanding mounts 74 support a pivot pin 82 that defines the pivot axis 58 and that pivotally supports the magazine 54, the cover 62, and the case 64. Those skilled in the art will understand that the illustrated construction of the spine 46 and pin 82 is only one possible manner for pivotally interconnecting the base 22, the magazine 54, the cover 62, and the case 64. Other pivot configurations can also be used.

As described thus far, the stapler 14 takes on the appearance of a typical stapler, and operates in a well-known manner for stapling sheets. However, the stapler 14 further includes an accessory storage chamber 86 (see FIGS. 3, 5, and 6) configured to store the detachable accessory 18. As illustrated in FIGS. 1-6, the storage chamber 86 is defined in the base 22, and more specifically in the rear end 30 of the base 22 above the bottom surface 38 and below the pivot axis 58. Locating the storage chamber 86 in this position enables the stapler 14 to maintain the size, appearance, and operability of a typical stapler, because moving the pivot axis 58 up to accommodate the storage chamber 86 does not require significant reconfiguration and re-sizing of the stapler 14.

Figure 3:
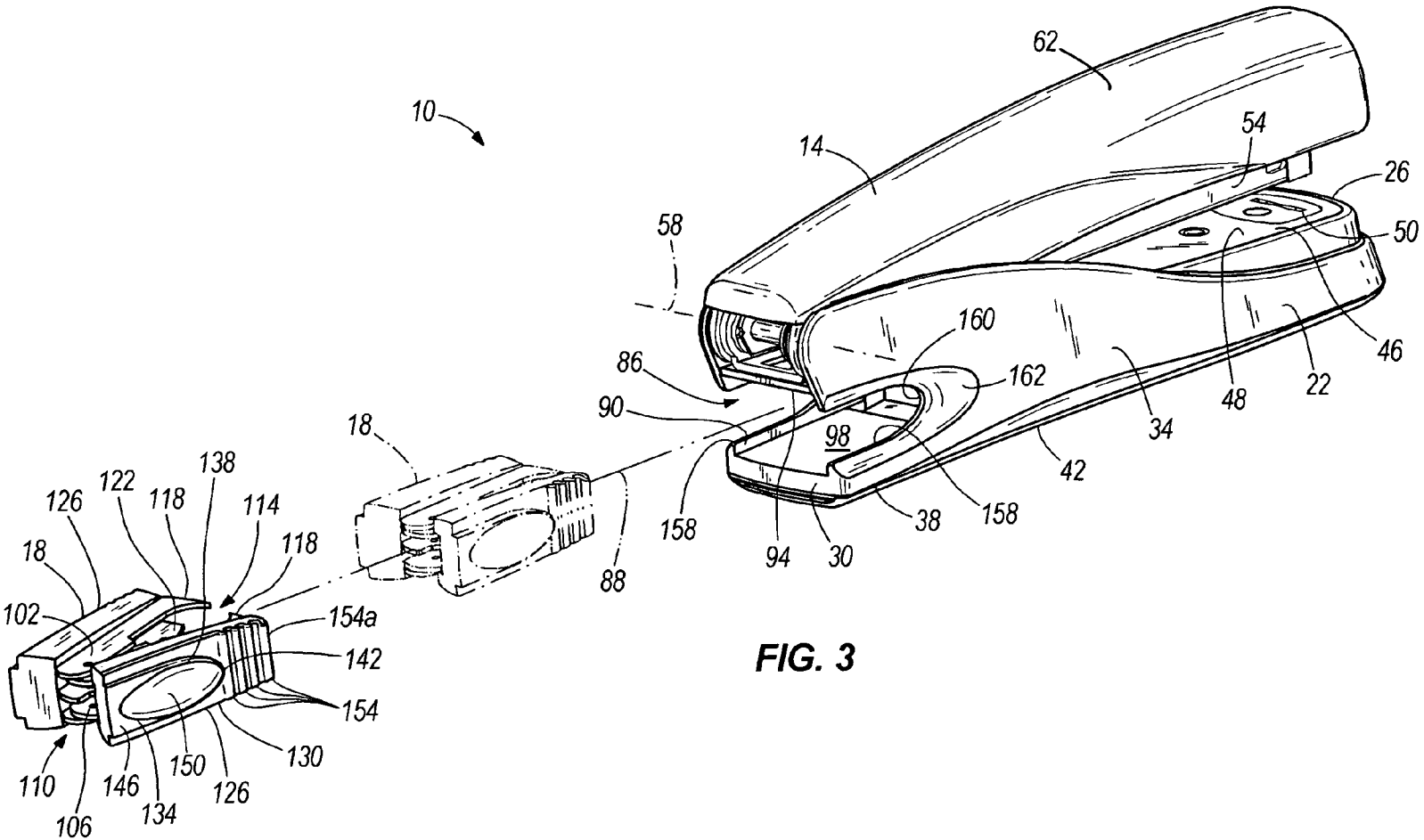
FIG. 3 is an exploded view of FIG. 2, illustrating the accessory detached from the stapler.
Figure 4:
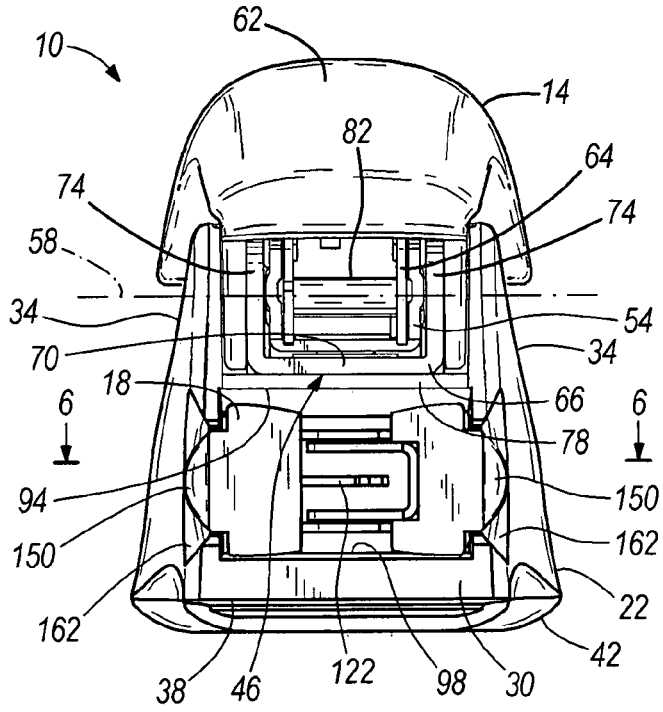
FIG. 4 is a rear view of the stapler and accessory combination of FIG. 1.
Figure 5:
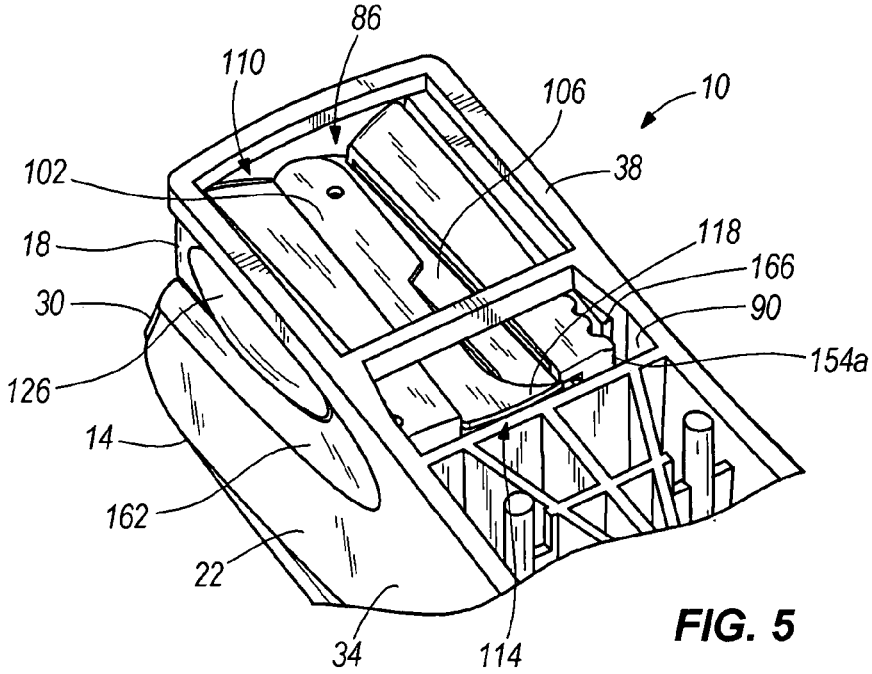
FIG. 5 is an enlarged partial bottom perspective view of the combination, shown with the slipper removed, and illustrating the accessory in the stored position.
Figures 6, 7:
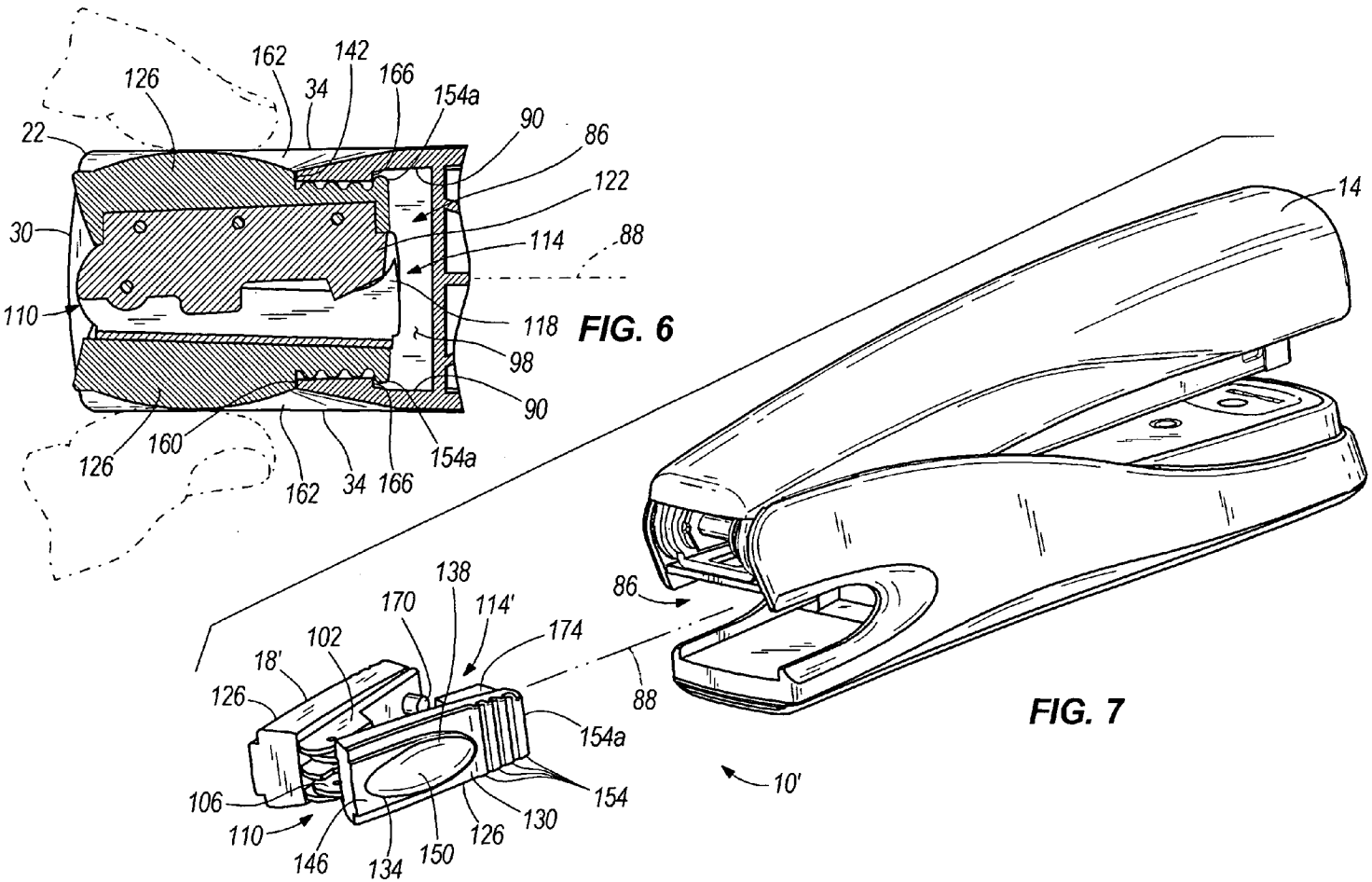
FIG. 6 is a partial section view taken through line 6—6 of FIG. 4.
FIG. 7 is an exploded rear perspective view illustrating another stapler and accessory combination embodying the invention.

As best seen in FIGS. 3, 5, and 6, the storage chamber 86 defines a longitudinal axis 88 and is formed in part by the interior surfaces 90 of the base sides 34, a lower surface 94 of the generally horizontal wall 78, and an upper surface 98 of the base bottom 38. The storage chamber 86 is open and accessible from the rear end 30 of the base 22 for insertion and withdrawal of the detachable accessory 18 in a direction substantially parallel to the longitudinal axis 88, as will be described in greater detail below.

In the embodiment illustrated in FIGS. 1-6, and with specific reference to FIG. 3, the detachable accessory 18 is a jaw-type staple remover having first and second jaws 102, 106 (best seen in FIG. 5) pivotally connected at a pivot end or non-operating end 110. The jaws 102, 106 further define an operating end 114 defining staple removing claws 118 operable to grasp and remove staples from a stack of sheets in a known manner. A substantially rigid tongue member 122 can be disposed between the claws 118 on one of the jaws 102, 106 to bend the staple crown and facilitate removal of the staple. The tongue member 122 is described in U.S. Pat. No. 5,513,833, assigned to ACCO Brands, Inc., and hereby incorporated by reference.

Each jaw 102, 106 supports a grasping portion 126 that can be grasped by a user to hold and operate the staple remover 18. In the illustrated embodiment, the grasping portions 126 are substantially identical, and each grasping portion 126 includes an outer surface 130 defining an elongated raised portion 134. In the illustrated embodiment, the elongated raised portion 134 is at least partially defined by an upstanding surface or wall 138 having an arcuate end 142. The upstanding wall 138 defines the perimeter of the elongated raised portion 134, which has a substantially planar portion 146 near the pivot end 110 that transitions into a substantially oval or elliptical-shaped protuberance 150.

The outer surface 130 of the grasping portion 126 further includes at least one raised rib 154 near the operating end 114. In the illustrated embodiment, each grasping portion 126 includes four ribs 154, with the rib **154*a* closest to the operating end 114 being slightly taller than the other ribs 154, for reasons that will be described further below. Together, the elongated raised portions 134 and the ribs 154 facilitate the user in securely grasping and holding the staple remover 18** with fingers in an operating position.

The remover 18 is oriented to be aligned with and generally parallel to the longitudinal axis 88 of the storage chamber 86, with the operating end 114 positioned to be inserted into the storage chamber 86 first, followed by the non-operating end 110. Inserting the remover 18 operating end first permits the claws 118 of the remover 18 to be safely housed within the base 22 and to be inaccessible from the outside of the base 22 when the remover 18 is stored in the storage chamber 86. This can prevent inadvertent injury that might occur by a user grasping the rear end 30 of the base 22 during manipulation or movement of the stapler 14. Furthermore, inserting the remover 18 operating end first substantially eliminates the need for the user to re-position his fingers from the normal operating finger position on the remover 18. Therefore, the user can maintain his same grip on the remover 18 during insertion, withdrawal, and use.

Alignment and entry of the remover 18 into the storage chamber is further facilitated by apertures in the form of elongated slots 158 (see FIG. 3) formed in each base side 34 and each having a distal end 160. Each slot 158 is sized and configured to receive the elongated raised portion 134 of a respective grasping portion 126. More specifically, the slots 158 are sized and configured to receive and engage the upstanding wall 138 such that the arcuate portion 142 engages the distal end 160, which acts as a stop against further entry of the remover 18 into the storage chamber 86. The outer surface of each base side 34 further includes a recessed area 162 surrounding the slot 158 that is contoured to ergonomically accept the user's finger and thumb during insertion and withdrawal of the remover 18 from the storage chamber 86.

As best illustrated in FIGS. 5 and 6, when the remover 18 is fully inserted into the storage chamber 86, the ribs **154*a* have passed shoulders 166 formed on the interior surfaces 90 of the base sides 34. When the user releases the grasping portions 126, the grasping portions 126 (as well as the attached jaws 102, 106) of the remover 18 spring apart slightly until further separation is prevented by engagement of the grasping portions 126 with the respective interior surfaces 90 of the base sides 34. This spring-biased engagement between the grasping portions 126 and the respective interior surfaces 90 of the base sides 34 helps retain the remover 18 in the storage chamber 86. Furthermore, the height of the rib 154*a* is such that the remover 18 cannot move rearwardly within the storage chamber 86 due to engagement between the rib 154*a* and the shoulder 166. Thus, the rib 154*a* acts as a locking member to substantially prevent the remover 18 from inadvertently moving rearwardly in the storage chamber 86**.

The process for inserting the staple remover 18 into the storage chamber 86 will now be described. As best illustrated in FIGS. 3 and 6, the user holds the remover 18 by grasping the grasping portions 126 in a manner comfortable for the particular user when removing a staple from a stapled stack of sheets. For example, a user may place a thumb on one grasping portion 126 and an index or middle finger on the other grasping portion 126 (as shown in phantom in FIG. 6). When staple removal is completed, the user, with his fingers grasping the remover 18 in substantially the same positions used during staple removal, aligns the remover 18 with the opening of the storage chamber 86. The user then squeezes the grasping portions 126 to pivot the jaws 102, 106 to a closed position (illustrated in phantom in FIG. 3) for insertion into the storage chamber 86. The remover 18 can then be inserted into the storage chamber 86.

To withdraw the remover 18 from the storage chamber 86, a user grasps the grasping portions 126 with his fingers in the normal staple-removing position. The grasping portions 126 are then squeezed together to pivot the jaws 102, 106 slightly, thereby enabling the ribs 154*a* to pass by the shoulders 166 without interference. The remover 18 can then be withdrawn from the storage chamber 86 in a direction substantially parallel to the longitudinal axis 88 and used to remove staples.

As best illustrated in FIG. 6, when stored in the storage chamber 86, the staple remover 18 is substantially completely housed within the base 22 such that the remover 18 is substantially entirely positioned within a footprint defined by the base 22. In addition to keeping the claws 118 of the stored remover 18 completely within the base 22 as mentioned above, it also enables the grasping portions 126 to be easily accessible to the user, but yet streamlined with the base 22 within the recessed areas 162 so as not to catch on items that may be adjacent the stapler 14 on the desktop.

FIG. 7 illustrates an alternative embodiment of a stapler and accessory combination 10' where the accessory 18' is a single hole paper punch instead of a staple remover 18. The punch 18' can be used with the stapler 14 in substantially the same manner described above for the remover 18. As seen in FIG. 7, the punch 18' is structurally similar to the remover 18, with like parts given like reference numerals. Instead of the staple removing claws 118, however, the punch 18' has an operating end 114' defined on one jaw 102 by a punch pin 170, and on the other jaw 106 by a punch die 174. Insertion and withdrawal of the punch 18' from the storage chamber 86 occurs in the same manner described above with respect to the remover 18, with the operating end 114' being inserted into the storage chamber 86 first as illustrated in FIG. 7.

Figure 8:
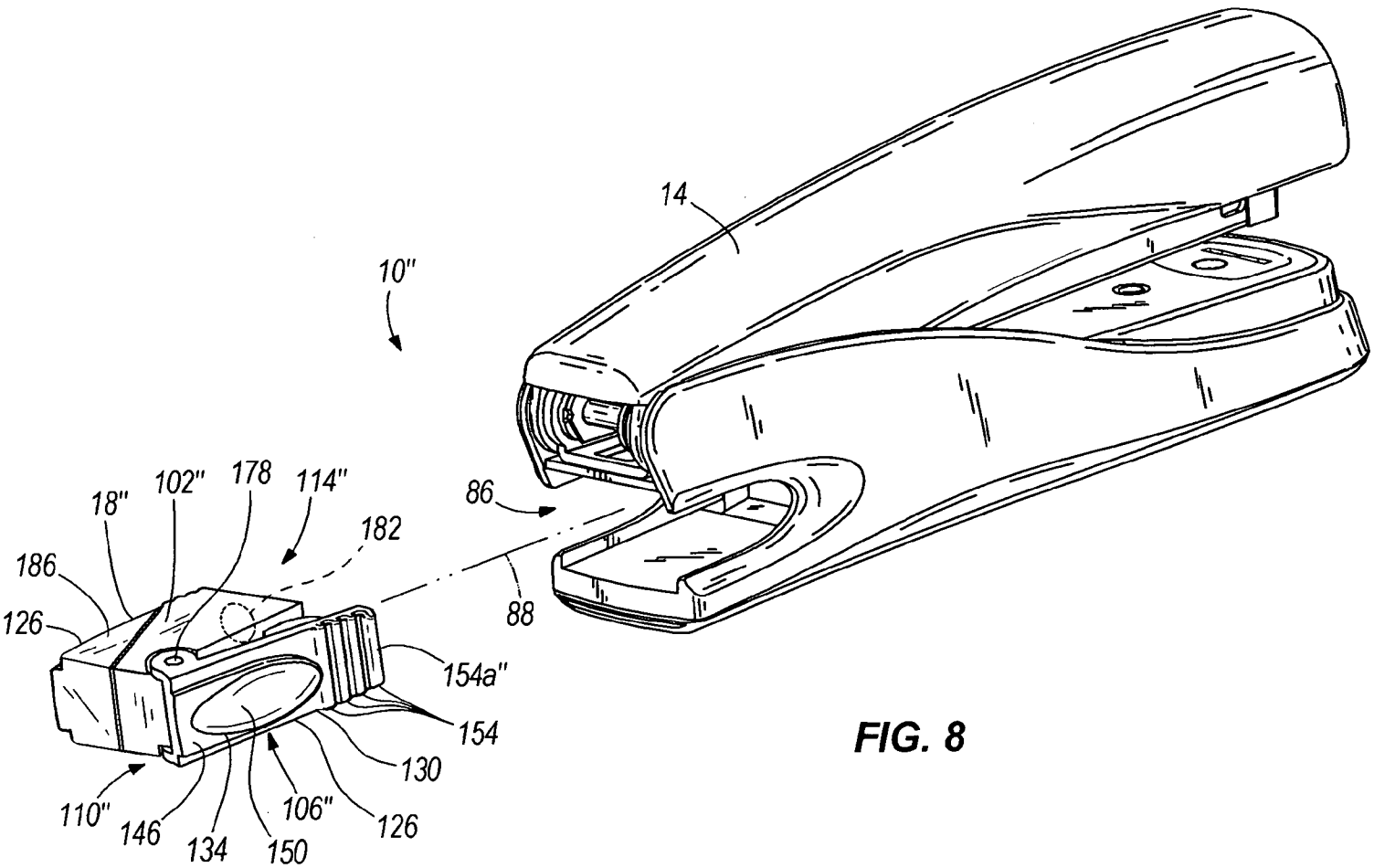
FIG. 8 is an exploded rear perspective view illustrating yet another stapler and accessory combination embodying the invention.

FIG. 8 illustrates another embodiment of a stapler and accessory combination 10" where the accessory 18" is a pencil sharpener. The sharpener 18" can also be used with the stapler 14 in substantially the same manner described above for the remover 18. As seen in FIG. 8, the sharpener 18" includes jaws 102" and 106" that pivot with respect to one another at pivot 178. The end of the sharpener 18" containing the pivot 178 defines the non-operating end 110". Pivoting of the jaws 102", 106" is not necessary for operation of the pencil sharpener 18", but rather facilitates securing the pencil sharpener 18" in the storage chamber 86 via the engagement between the rib 154*a*" and the shoulder 166 (see FIG. 5).

The jaw 102" defines the working portion of the pencil sharpener, including the pencil-insertion opening 182 formed in the operating end 114". A removable cover 186 is secured on the jaw 102" for emptying shavings created during sharpening of a pencil. Alternatively, the shavings could exit the sharpener at a slot (not shown) formed in the jaw 102". Insertion and withdrawal of the sharpener 18" from the storage chamber 86 occurs in the same manner described above with respect to the remover 18, with the operating end 114" being inserted into the storage chamber 86 first as illustrated in FIG. 8.

Figure 9:
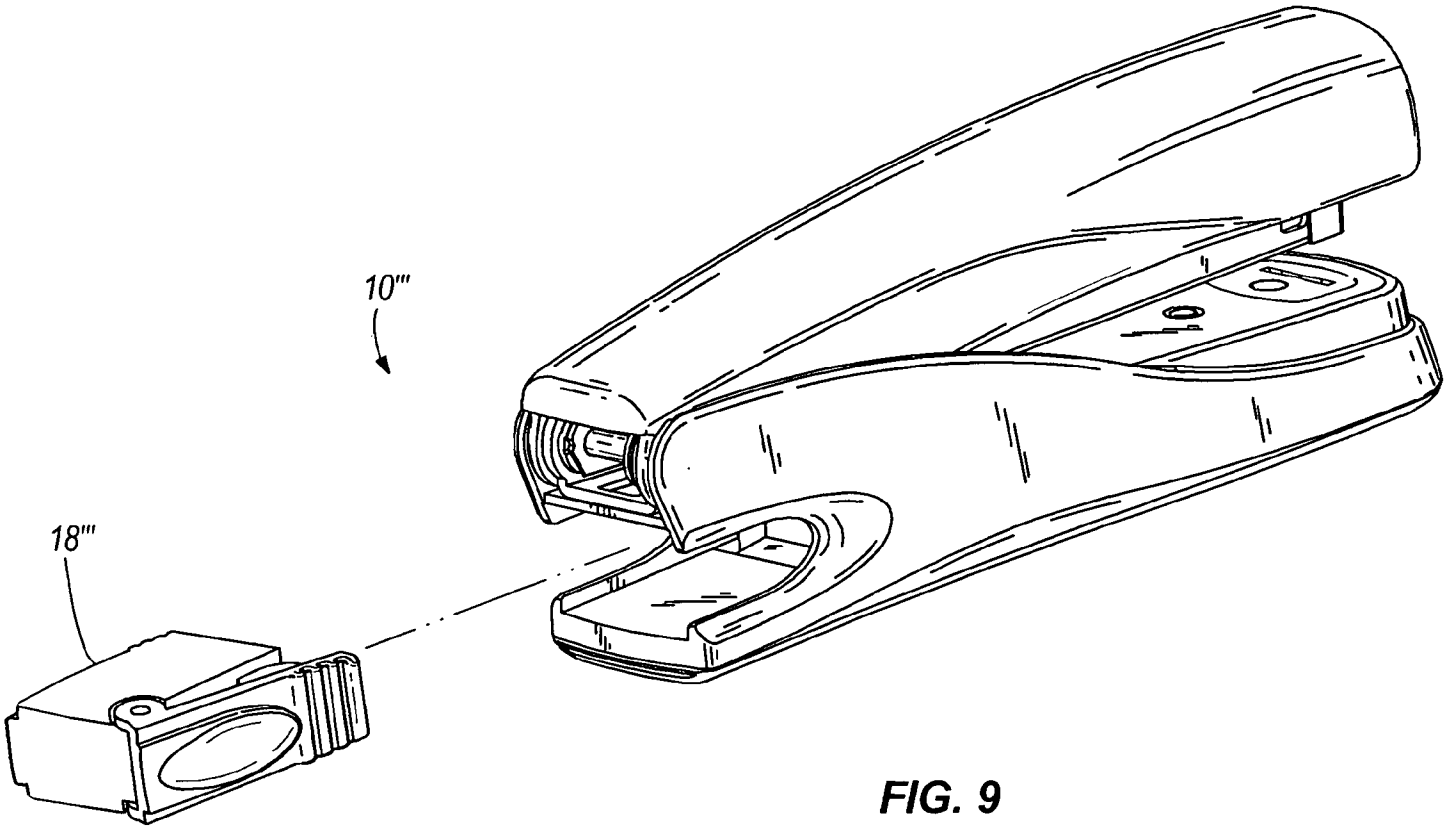
FIG. 9 is an exploded rear perspective view illustrating another stapler and accessory combination where the accessory is schematically shown to represent a number of possible accessory devices.

While the stapler 14 is illustrated as being used to detachably house a staple remover 18, a hole punch 18', and a pencil sharpener 18", those skilled in the art will understand that other accessory devices can also be used. For example, other accessory devices (represented schematically in FIG. 9 by the reference numeral 18'") could include adhesive flag or tape dispensers, a mini-stapler, a USB memory stick, a writing or marking device (e.g., a pencil, pen, marker, highlighter, and the like), a laser pointer, a letter opener, a scissors, and other devices. The stapler 14 can be sold with one or more of the accessory devices 18, 18', 18", 18'" and/or the accessory devices 18, 18', 18", 18'" can be sold separately. A user can select which accessory device 18, 18', 18", 18'" to store in the storage chamber 86 based on typical usage requirements.

Various features of the invention are set forth in the following claims.

The invention claimed is:

1. A stapler and detachable accessory combination comprising:

a stapler having a base with an accessory storage chamber, the storage chamber having an open end; and a detachable accessory defining an operating end, a non-operating end, and a grasping portion intermediate and aligned with the operating and non-operating ends, the grasping portion defining a location where a user both applies force while operating the detachable accessory and grasps the accessory for insertion into and removal from the storage chamber, the detachable accessory being removably positioned in the storage chamber with the non-operating end near the open end, the operating end further from the open end in the storage chamber, and the grasping portion exposed outside of the storage chamber.

2. The stapler and detachable accessory combination of claim 1, wherein the accessory is a jaw-type staple remover, wherein the operating end is an end of the remover defining staple grasping claws, and wherein the non-operating end is a pivot end.

3. The stapler and detachable accessory combination of claim 1, wherein the accessory is a hole punch, wherein the operating end is an end of the punch having a punch pin, and wherein the non-operating end is a pivot end.

4. The stapler and detachable accessory combination of claim 1, wherein the accessory is a pencil sharpener, and wherein the operating end is an end of the sharpener defining a pencil-insertion opening.

5. The stapler and detachable accessory combination of claim 1, wherein the base further comprises an aperture communicating with the storage chamber, and wherein the grasping portion is at least partially received in the aperture.

6. The stapler and detachable accessory combination of claim 5, wherein the grasping portion includes a raised portion that extends at least partially into the aperture.

7. The stapler and detachable accessory combination of claim 5, wherein the aperture is a slot in the base extending from the open end of the storage chamber, and wherein the grasping portion is slidably received in the slot during insertion of the accessory into the storage chamber.

8. The stapler and detachable accessory combination of claim 7, wherein the slot defines a terminal end and wherein the grasping portion engages the terminal end to substantially prevent further insertion of the accessory into the storage chamber.

9. The stapler and detachable accessory combination of claim 7, wherein the base includes a recessed area adjacent the slot to facilitate a user grasping the grasping portion.

10. The stapler and detachable accessory combination of claim 1, wherein the accessory includes a locking member removably securing the accessory in the storage chamber.

11. The stapler and detachable accessory combination of claim 10, wherein the locking member is a rib on an outer surface of the grasping portion, the rib engaging with a shoulder on an interior surface of the base.

12. The stapler and detachable accessory combination of claim 10, wherein the locking member is biased into engagement with the stapler to removably secure the accessory in the storage chamber.

13. The stapler and detachable accessory combination of claim 1, wherein the stapler is a manual stapler having a magazine pivotally attached to the base at a pivot point, and wherein the storage chamber is located between a bottom of the base and the pivot point.

14. The stapler and detachable accessory combination of claim 1, wherein the base defines a footprint, and wherein the accessory is positioned substantially entirely within the footprint when stored in the storage chamber.

15. The stapler and detachable accessory combination of claim 1, wherein the detachable accessory is one of a staple remover, a hole punch, a pencil sharpener, an adhesive flag dispenser, a tape dispenser, a mini-stapler, a USB memory stick, a marking device, a laser pointer, a letter opener, and a scissors.

16. The stapler and detachable accessory combination of claim 1, wherein each of the operating end, the non-operating end, and the grasping portion are substantially the same width.

17. The stapler and detachable accessory combination of claim 1, wherein the grasping portion is defined by oppositely facing surfaces, and wherein each of the oppositely facing surfaces is exposed outside of the storage chamber when the detachable accessory is removably positioned in the storage chamber.

* * * * *